United States Patent [19]

Gasser

[11] Patent Number: 4,885,859

[45] Date of Patent: Dec. 12, 1989

[54] FOLDING CARD

[75] Inventor: Joachim Gasser, Kirchdorf, Fed. Rep. of Germany

[73] Assignee: Refeka Werbemittel GmbH, Munich, Fed. Rep. of Germany

[21] Appl. No.: 187,363

[22] Filed: Apr. 28, 1988

[51] Int. Cl.[4] ..... B42D 15/04; G09F 1/08

[52] U.S. Cl. ..... 40/539; 40/124.1

[58] Field of Search ..... 40/124.1, 445, 539, 40/160; 446/147, 148; D19/29

[56] References Cited

U.S. PATENT DOCUMENTS

| | | | |
|---|---|---|---|
| 2,080,997 | 5/1937 | Beckelman | 40/539 |
| 2,544,783 | 3/1951 | Freedman et al. . | |
| 2,546,878 | 3/1951 | Townley | 40/539 |
| 2,586,071 | 2/1952 | Manen-Mayol | 40/539 |

FOREIGN PATENT DOCUMENTS

| | | | |
|---|---|---|---|
| 1150040 | 1/1958 | France | 40/539 |
| 1257580 | 2/1961 | France . | |

*Primary Examiner*—Richard J. Apley
*Assistant Examiner*—J. Welsh
*Attorney, Agent, or Firm*—Robbins & Laramie

[57] ABSTRACT

The invention relates to a folding card 1 with a cover 2 that is connected to a back 3 by at least one fold line $F_1$ and with an internal folding system 4, that is connected at least to the inside surface 3*a* of the back 3 and can assume a three-dimensional form when the card is unfolded. In order to achieve a particularly effective and optimal effect, the internal folding system 4 consists of at least two superimposed frame elements that change their relative positions when the card is unfolded and whose windows are of differing sizes, whereby the size of the windows increases in the order of the successively overlapping frame elements. The largest window is the one located furthest from the back.

13 Claims, 4 Drawing Sheets

FOLDING CARD

BACKGROUND OF THE INVENTION

The invention refers to a folding card with a cover that is connected to a back by at least one fold line, and has an internal folding system that is connected at least to the inside surface of the back, can assume a three-dimensional form when the card is unfolded, and has at least two superimposed frame elements that change their relative positions when the card is unfolded.

Folding cards of this type are known, for example, from French patent No. 828 362. They can be used in particular in advertising or as greeting cards. In the closed position, the cover of the card rests on the surface of the back. When the cover is folded open, a folding system attached between the cover and the back then appears and shows, for example, figures or elements moving in contrasting directions. This is intended to surprise the viewer or in some special manner appeal to him through the contents of the card.

The problem of the invention is to create a folding card of this type in which a special design results in a special effect on the viewer, and which can on the other hand be simply produced.

SUMMARY OF THE INVENTION

This problem is solved for a folding card of the type described above through a design in which the frame elements form windows of differing sizes, whereby the size of the windows, beginning with the frame element closest to the inside surface of the back, increases in the order of the successively overlapping frame elements.

A folding system with these characteristics makes it possible, through overlapping frame elements that define windows of differing sizes and by imprinting appropriate designs, to generate a sense of spatial depth of the design depicted, which draws particular attention from a viewer. For example, behind the smallest window in the back surface area, an advertising slogan or even a name can be printed. Because of the spatial effect, the vision of the viewer is then directed spatially towards this advertising slogan. The windows or frame elements, which overlap on many planes, can be simply produced, so that on the whole the card can be easily produced and used as a particularly effective means of advertising.

One development of the invention provides for having the frame elements arranged such that in the unfolded position the windows are positioned symmetrically to a common axis of symmetry. In this solution, the windows of the spaced frame elements in the 90° unfolded position overlap with a common center, and it is also possible to cause the generated spatial impression to drift to the left and to the right of this symmetrical position.

In a currently preferred embodiment, the windows are rectangular. However, square or round windows, or windows with other shapes can also be used.

If the same corners of each superimposed window are located on a common connecting line, it is possible to create for the viewer through the superimposed windows the impression of continuous edges, for example of corner edges of a space, etc. This opens up advantageous possibilities for printing and generating optical effects.

In a further development of the invention, the end points of the connecting line form the corners of a rectangle on the inside surface of the back. In every unfolded position of the cover with respect to the back, the image windows thus advance optically towards this fixed rectangle on the internal surface of the back. This rectangle thus constitutes a stationary visual surface that can then feature an appropriate advertising message. Regardless or the unfolded position, the eyes of the viewer will always be focused on this rectangle.

With respect to the production of the card, a preferred embodiment provides for the folding system having a support frame with a bottom side, two side walls and a top side, whereby the top side is the frame element with the largest window and whereby the top side, the side walls and the bottom side are attached to each other by fold lines and form a cuboid when the cover is unfolded to a 90° position with respect to the back. The back surface of this support frame can be attached to the inside surface of the back of the card, while the side wall facing the cover can be attached to the inside surface of the cover. When the cover and back are unfolded, the support frame is raised until it finally assumes a cuboidal form in the 90° unfolded position. The window with the largest aperture is then located on the top side.

The other frame elements are then positioned parallel to the top side of the support frame on the inside of the support frame and each adjoin the inside surfaces of the side walls by fold lines. This construction makes it possible to easily superimpose the frame elements at intervals, so that the desired spatial effect is achieved.

The total length or the side walls and of the top side corresponds to the total length of the back and of the cover, so that in the closed position the support frame folds together as far as the free front edge of the cover and of the back and extends between these two.

It has been seen that with only three frame elements (including the largest window on the support frame), surprisingly effective panorama images can be generated.

For production it is also advantageous if the folding card is made of glued-together pressed cardboard. In this way, the card can be produced very easily and economically.

One embodiment provides for having the cover connected to the back along a frontal edge by a fold line, and for having the inside surface of the cover connected to the appropriate side wall of the folding system, so that the folding system automatically assumes its unfolded, three-dimensional form when the cover is opened. In this solution, the cover is connected by one piece to the frontal edge of the rectangular back section by a fold line. The length of the cover corresponds to the length of the back section. By having the cover connected to the side wall of the folding system at the level of the side wall, the automatic opening motion when the cover is opened adjusts, i.e., the folding system is put into its spatially unfolded position. In a 90° unfolded position of the cover, the folding system then has the shape of a cuboid.

Another solution provides for having the cover attached by fold lines to one of the longitudinal sides of the back. In this way, the folding system is not automatically opened up when the cover is opened, although this can be achieved through vertical alignment of the card, for example by itself, in its unfolded position or using one's hands. In this context, a preferred embodiment provides for a two-part configuration of the cover, whereby a first part of the cover is attached by fold lines to one longitudinal edge of the back and a second part of the cover is attached to the other longitudinal edge of the back and whereby the two parts of the cover, in order to close the card, are folded towards each other and are held together by at least one tab that is located on one part of the cover and can be inserted in a slit in the other part of the cover. In this solution, the cover consists of two parts that can be folded towards one another and can close the card with a connection using a slit and a tab, whereby the inside folding system is then positioned between the cover and the back when the card is in the closed position. By removing the tab from the slit, the card is opened and the folding system can then be unfolded. One advantage of this solution is that the card can be positioned on its lower edges and then remain in that position, whereby its longitudinal sides point upwardly. The two parts of the cover act as lateral wings and can be imprinted accordingly. This type of card can, for example, have postal markings on the side of the back facing outward, so that the card can be used as postcard or as a greeting card. In this context, a relatively thin cardboard or somewhat strong paper can be used for the back and cover, so that the overall card remains relatively light.

BRIEF DESCRIPTION OF THE DRAWINGS

The invention is further explained and described below on the basis of the embodiments depicted in the drawings, in which.

DETAILED DESCRIPTION OF THE PREFERRED EMBODIMENT

Figure 1:
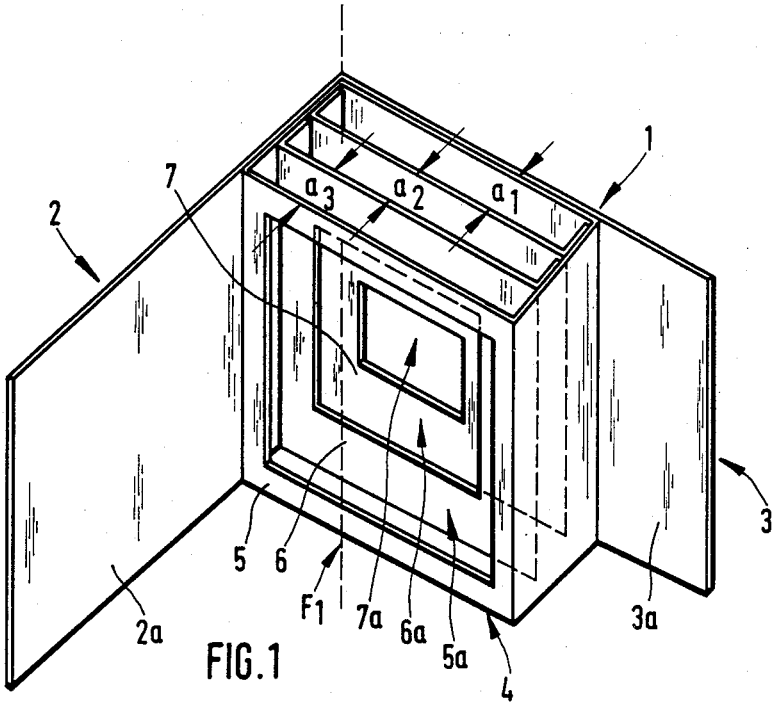
FIG. 1 shows in a perspective top view one embodiment of the folding card according to the invention.

FIG. 1 is a perspective depiction of a card according to the invention; the overall card is designated as 1. The card has a cover 2 and a back 3. The cover 2 and the back 3 meet at a fold line $F_1$ and can be folded against one another along this line. FIG. 1 shows a position in which the cover is folded against the back at a 90° angle.

Inside, between the cover and the back, is a folding system 4 that assumes a spatial, three-dimensional form when the cover 2 is unfolded with respect to the back 3, as can be seen in FIG. 1.

In the embodiment depicted, the folding system consists of three superimposed frame elements 5, 6 and 7. In the frame element that is the greatest distance from the back 3 (a1+a2+a3), a window 5*a* is cut out. In the frame element 6 that is next to frame element 5 in the direction of the back 3, a window 6*a* is similarly cut out, but its dimensions are smaller than those of window 5*a*. Between the frame element 6 and the back 3, there is another frame element 7, at a distance a1 from the inside surface 3*a* of the back 3, which similarly has a window 7*a* that is even smaller than both of the windows 5*a* and 6*a*.

The distances a1, a2 and a3 are equal.

Figure 2:
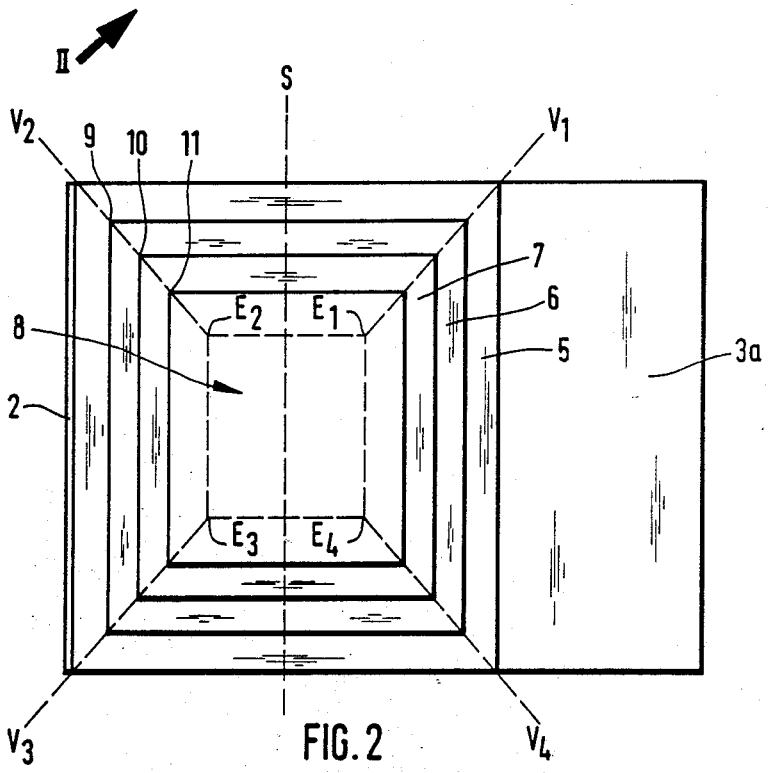
FIG. 2 shows a front view in the direction of arrow II of FIG. 1 whereby the cover is shown in cross-section.
Figure 3:
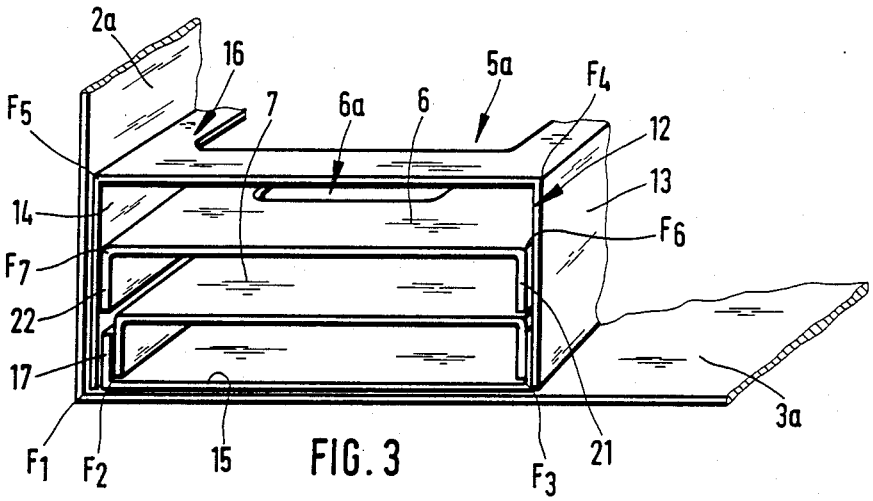
FIG. 3 shows in a perspective detail the support frame with the frame elements and parts of the cover, as well as the back.

FIG. 2 shows a view in the direction of arrow II of the card unfolded by 90° according to FIG. 3. There it can be seen that the superimposed windows 5*a*, 6*a* and 7*a*, which are formed by the frame elements 5, 6 and 7 and are successively smaller in that order, are positioned symmetrically to an axis of symmetry S. The individual windows are dimensioned such that the respectively corresponding corners each lie on the imaginary connecting lines $V_1$ through $V_4$. In FIG. 2, only the upper left-hand corners 9, 10 and 11 are drawn in, which lie on the common connecting line $V_2$. Since—as can be seen in FIG. 1—the frame elements 5, 6 and 7 are positioned at spatial intervals with respect to one another and on the other hand the windows are successively smaller as one moves towards the back 3, the result is an effective spatial, optical effect. The connecting lines $V_1$ through $V_4$ meet at corresponding end points $E_1$ through $E_4$ on the inside surface 3*a* of the back 3; these end points define an imaginary rectangle 8. When the cover 2 is swung towards the back 3, the windows also shift towards one another, although the connecting lines $V_1$ through $V_4$ join at the end points $E_1$ through $E_4$ in every position, so that this rectangle 8 defined by these end points $E_1$ through $E_4$ remains in place regardless of the swinging position. In this way, the vision of the viewer is always directed towards the rectangle 8. Advertising slogans or even names can be imprinted there, for example.

Figure 4:
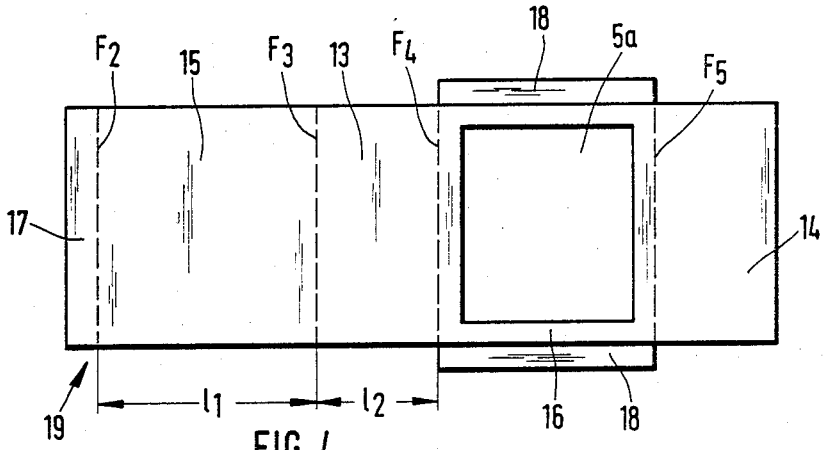
FIG. 4 shows the layout of the support frame.

In FIG. 4, the structure of the folding system is shown in greater detail. There is can be seen that the folding system has a support frame 12 that assumes a cuboidal form in the 90° position of the cover with respect to the back, whereby the frontal edges of the cuboid are open. The support frame 12 has an attachment tab 17, a bottom side 15, a side wall 13, a top side 16, which forms the upper frame element 5, and another side wall 14. The support frame is attached to the inside surface 2*a* of the cover 2 with the outside surface of the side wall 14. Similarly, the outside surface of the bottom side 15 is attached to the inside surface 3*a* of the back 3 with adhesive. Inside the support frame 12, the two frame elements 6 and 7 are positioned at the intervals indicated in FIG. 1. The frame element 6 has laterally bent attachment tabs 21 and 22 that are attached by fold lines $F_6$ and $F_7$ to the horizontally positioned frames adjacent to the window 6*a*. The outside surfaces of the attachment tabs are glued to the inside surfaces of the side wails 13 and 14. The frame element 7 is correspondingly configured, the only difference being that the window 7*a* (not shown in FIG. 4) is smaller than the window 6*a* of the frame element 6.

Figure 5:
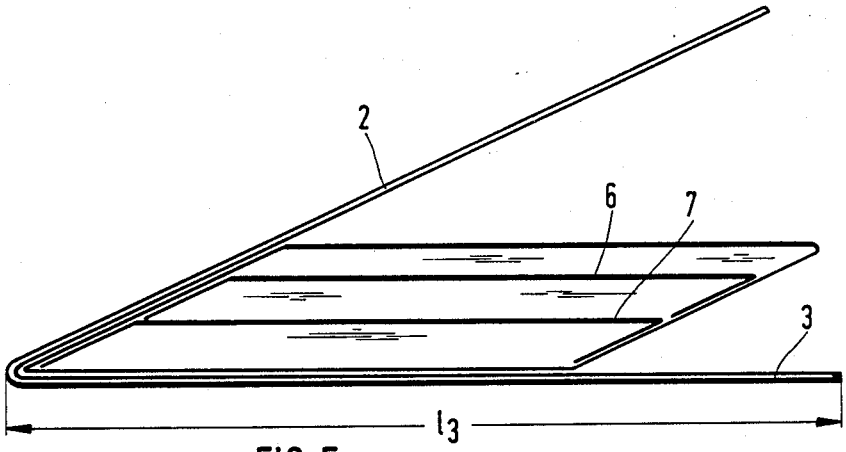
FIG. 5 is a side view displayed by the card in a position during the process of opening.

Since the frame elements 6 and 7 are each held in the support frame 12 by fold lines and the support frame itself has fold lines $F_2$ through $F_5$, the support frame folds up when the cover is folded together in the direction of the back, thereby there is a parallel shift in the individual frame elements, until the point at which these elements are essentially superimposed, with no distance between them. FIG. 5 shows an interim stage passed through by the support frame when the card is folded together (and naturally when it is unfolded as well). Because of this construction and the use of the support frame and of the frame elements positioned inside the support frame, the card can be folded together so as to be very flat, and can also be produced very simply.

Figure 6:
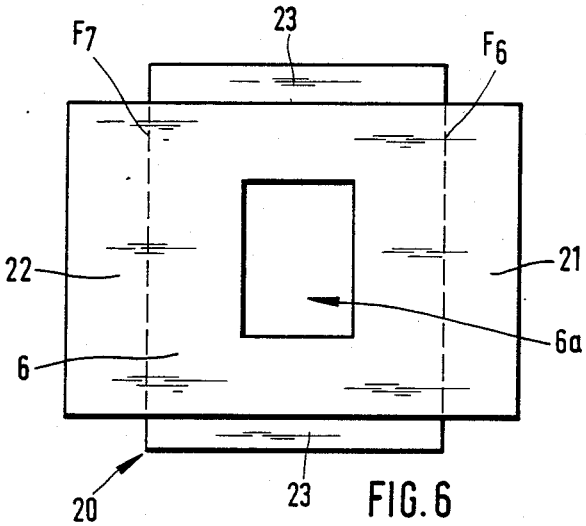
FIG. 6 shows the layout of the frame element 6.

The individual parts of the card consist of thin cardboard, such as cardboard of a strength of 0.2 to 0.5 mm. The pressed parts needed are extremely simple, as FIGS. 4 and 6 show. The layout of the cover and back need not be shown. It consists of an oblong strip, the middle of which is divided by a fold line $F_1$.

The layout 19 of the support frame 12 is shown in FIG. 4. The way in which the attachment tab 17 connects to the bottom side 15 by a fold line $F_2$ can be seen here. The side wall 13 is then attached to this by the fold line $F_3$. This is followed by the top side 16 by the fold line $F_4$, which forms the frame element 5 and has the punched out area 5*a*, which forms the window. The side wall 14 is then connected to this by the fold line $F_5$. The figure shows upwardly and downwardly protruding reinforcement tabs 18, which are intended to reinforce the free bridges that border the window 5*a* in FIG. 4 above and below, in that they can be folded inwardly. In this area, the frame is twice as strong after these reinforcement tabs have been folded in. The total length of the bottom side 15 and of the side wall 13 comes to $L_1+L_2$, as does the total length of the upper side 16 and the side wall 14 (cf. FIG. 4), and corresponds to the length $L_3$ of the back 3 or of the cover 2 of the card. Because of this, the support frame ends up with the fold edge $F_4$ on a level with the cover 2 and the back 3 when in the folded together position In this way, the space available inside is optimally utilized.

The layout of the two frame elements 6 and 7 is also extremely simple, as FIG. 6 shows. Because the frame element 7 is configured in keeping with the layout of the frame element 6 (except for the size of the window 6*a*), only the layout 20 of the frame element 6 is depicted. One can see the two attachment tabs 21 and 22, as well as the reinforcement tabs 23 on the free side, which can be folded in in order to reinforce the frame in this area.

The fold lines $F_6$ and $F_7$ make it possible to fold and unfold the card (cf. FIG. 5).

Figure 7:
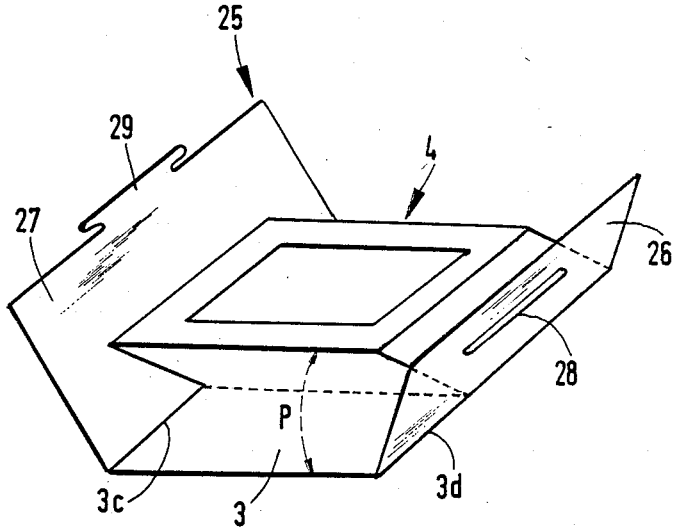
FIG. 7 shows a perspective depiction of another embodiment of the card according to the invention.

FIG. 7 shows another embodiment of a folding card. In this embodiment, the two parts 26 and 27 of the cover 25 are connected to the rectangular back 3 along the longitudinal edges 3*d* and 3*c* by fold lines. There is a tab 29 on the free edge of part 27 of the cover. A corresponding slit recession 28 is configured in the part 26 of the cover, so that whenever the only schematically depicted folding system 4 is folded together towards the back 3 in the direction of the arrow P, the card can be closed by inserting the tab 29 into the slit.

Figure 8:
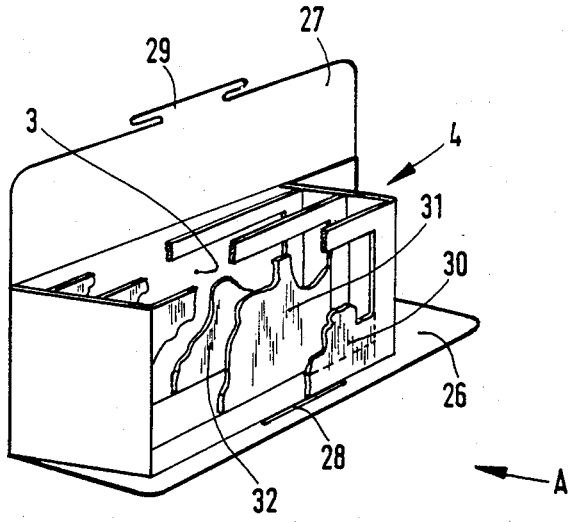
FIG. 8 shows the card depicted in FIG. 7, whereby design elements can be discerned in the individual windows.

FIG. 8 shows the card with the basic design explained on the basis of FIG. 7 in an open position In the individual windows, design elements 30, 31 and 32 are shown, which when viewed in the direction of arrow A combine into a complete spatial design. For example, the overall image of a city can be depicted on the back wall 3. The individual design elements 30, 31 and 32 then repeat individual designs from the overall image and in this way emphasize these individual designs from the overall image on the back. The design elements can be stamped out during the stamping of the frame elements. Of course, it is also possible to affix corresponding design elements 30 through 32 on the windows from the side that cannot be seen.

It is clear that the invention can naturally be realized with more than three superimposed frame elements. The more frame elements that are used, the more detailed will be the spatial impressions generated. However, this is offset by the somewhat greater expenses involved in producing and assembling the card. The windows can be nearly any shape, such as round or rectangular. In any case, the elements used can be appropriately imprinted prior to assembly, so that there are spatial images when the card is unfolded.

What is claimed is:

1. A folding card with a cover that is connected to a back by at least one fold line and with an internal folding system that is connected at least to the inside surface of the back, can assume a three-dimensional form when the card is opened, and has at least two superimposed frame elements that change their relative positions when the card is unfolded, wherein:

the frame elements (5, 6, 7) form Windows (5*a*, 6*a*, 7*a*) of differing sizes whereby the size of the windows (5*a*, 6*a*, 7*a*), beginning with the frame element (7) closest to the inside surface (3*a*) of the back (3), increases in the order of the successively overlapping frame elements (5, 6, 7); and the folding system (4) has a support frame (12) with a bottom side (15), two side walls (13, 14) and a top side (16), whereby the top side (16) is the frame element (5) with the largest window (5) and whereby the top side (16), the side walls (13, 14) and the bottom side (15) are attached to each other by fold lines ($F_2$, $F_3$, $F_4$, $F_5$) and form a cuboid when the cover is unfolded to a 90° position with respect to the back (3) (FIG. 3).

2. A folding card according to claim 1, wherein:

the frame elements (5, 6, 7) are arranged such that in the unfolded position the windows (5*a*, 6*a*, 7*a*) are positioned symmetrically to a common axis of symmetry (S)

3. A folding card according to claim 1, wherein:

the windows (5*a*, 6*a*, 7*a*) are rectangular.

4. A folding card according to claim 3, wherein:

the corresponding superimposed corners (9, 10, 11) of the windows (5*a*, 6*a*, 7*a*) are positioned on a common connecting line ($V_1$, $V_2$, $V_3$, $V_4$).

5. A folding card according to claim 4, wherein:

the end points ($E_1$, $E_2$, $E_3$, $E_4$) of the connecting lines ($V_1$ through $V_4$) form the corners of a rectangle (8) on the inside surface (3*a*) of the back (3).

6. A folding card according to claim 1, wherein:

the total length ($L_1+L_2$) of one side wall (13, 14) and of the top side or bottom side (16, 15) corresponds to the total length ($L_3$) of the back (3) or of the cover (2).

7. A folding card according to claim 1, wherein:

the other frame elements (6, 7) are positioned parallel to the top side of the support frame (12) on the inside of the support frame (12) and are each attached to the inside surfaces of the side walls (13, 14) by fold lines ($F_6$, $F_7$).

8. A folding card according to claim 1, wherein:

the folding card (1) has three frame elements (5, 6, 7).

9. A folding card according to claim 1, wherein:

the folding card (4) is made of glued-together pressed cardboard.

10. A folding card according to claim 1, wherein:

the cover (2) is connected to the back along a frontal edge (36) by a fold line ($F_1$), and the inside surface of the cover (2) is connected to the appropriate side wall (14) of the folding system, so that the folding system automatically assumes its unfolded, three-dimensional form when the cover is opened.

11. A folding card according to claim 1, wherein:
the cover (25) is attached by fold lines to one of the longitudinal sides (*3c, 3d*) of the back (3).

12. A folding card according to claim 11, wherein:
the cover (25) is configured in two parts, whereby a first part of the cover (26) is attached by fold lines to one longitudinal edge (*3d*) of the back and a second part of the cover (27) is attached to the other longitudinal edge (*3c*) of the back and whereby the two parts of the cover, in order to close the card, are folded towards each other and are held together by at least one tab (29) that is located on one part of the cover (27) and can be inserted in a slit (28) in the other part of the cover (26).

13. A folding card according to claim 1, wherein:
printed design elements (30, 31, 32) are positioned in the windows (*5a, 6a, 7a*) and combine into an overall design when the card is in the open position.

* * * * *